US007537142B2

(12) United States Patent
Yau et al.

(10) Patent No.: US 7,537,142 B2
(45) Date of Patent: May 26, 2009

(54) PINCH CLIP GARMENT HANGER WITH MODULAR FRICTION PADS

(75) Inventors: Wai Shing Yau, Kowloon (HK); Wai Keung Yau, Kowloon (HK)

(73) Assignee: Wai Shing Plastic Products Ltd., Kowloon (HK)

( * ) Notice: Subject to any disclaimer, the term of this patent is extended or adjusted under 35 U.S.C. 154(b) by 0 days.

(21) Appl. No.: 11/697,504

(22) Filed: Apr. 6, 2007

(65) Prior Publication Data

US 2007/0228088 A1 Oct. 4, 2007

Related U.S. Application Data

(60) Provisional application No. 60/744,695, filed on Apr. 12, 2006.

(51) Int. Cl.
*A41D 27/22* (2006.01)

(52) U.S. Cl. ..... 223/96; 223/85; 223/95

(58) Field of Classification Search ..... 223/85, 223/88, 90, 91, 93, 96, DIG. 2, 95
See application file for complete search history.

(56) References Cited

U.S. PATENT DOCUMENTS 1,997,251 A * 4/1935 Field ..... 223/90
3,946,915 A 3/1976 Crane
3,987,898 A 10/1976 Crane
3,991,884 A 11/1976 DeMaagd et al.
4,007,861 A 2/1977 Duester et al.
4,017,990 A 4/1977 Garrison
4,023,762 A 5/1977 Batts et al.
4,034,865 A 7/1977 Batts et al.
4,034,903 A 7/1977 Batts
4,046,293 A 9/1977 Garrison
D246,817 S 1/1978 Mainetti
4,071,146 A 1/1978 Batts
D247,150 S 2/1978 Duester
4,073,457 A 2/1978 Batts et al.
4,101,059 A 7/1978 Batts et al.
D249,619 S 9/1978 Wolff
4,115,940 A 9/1978 Phillips
4,123,864 A 11/1978 Batts et al.
4,157,782 A 6/1979 Mainetti
D253,081 S 10/1979 Mainetti
4,177,908 A 12/1979 Batts et al.
4,187,967 A 2/1980 Garrison
4,192,441 A 3/1980 Batts
4,194,274 A 3/1980 Garrison
4,198,773 A 4/1980 Batts et al.
4,231,500 A 11/1980 Mainetti
D259,087 S 5/1981 Mainetti
4,295,585 A 10/1981 Garrison
D267,920 S 2/1983 Batts et al.
D267,921 S 2/1983 Batts
4,381,599 A 5/1983 Duester et al.
4,395,799 A 8/1983 Batts (Continued)

*Primary Examiner*—Gary L. Welch
*Assistant Examiner*—Nathan E Durham
(74) *Attorney, Agent, or Firm*—Baker & McKenzie LLP

(57) ABSTRACT

Disclosed herein is a pinch clip garment hanger. The pinch clip garment hanger includes a first jaw member, and a second jaw member pivotally secured to the first jaw member. At least one jaw member includes a friction pad, a receiving portion that houses the friction pad, and a securing device operable to secure the friction pad to the receiving portion.

15 Claims, 6 Drawing Sheets

U.S. PATENT DOCUMENTS

| | | | | |
|---|---|---|---|---|
| D271,649 | S | | 12/1983 | Batts et al. |
| D272,502 | S | | 2/1984 | Batts et al. |
| D273,072 | S | | 3/1984 | Batts et al. |
| D273,073 | S | | 3/1984 | Batts et al. |
| 4,446,996 | A | | 5/1984 | Garrison |
| 4,450,639 | A | | 5/1984 | Duester |
| D281,470 | S | | 11/1985 | Batts |
| 4,556,158 | A | | 12/1985 | Blanchard et al. |
| 4,565,309 | A | | 1/1986 | Batts et al. |
| D283,854 | S | | 5/1986 | Marshall |
| D284,427 | S | | 7/1986 | Bredeweg |
| 4,600,132 | A | | 7/1986 | Blanchard |
| D286,584 | S | | 11/1986 | Blanchard |
| D286,585 | S | | 11/1986 | Blanchard |
| 4,638,930 | A | | 1/1987 | Blanchard |
| 4,653,678 | A | | 3/1987 | Blanchard et al. |
| 4,660,739 | A | | 4/1987 | Dooley et al. |
| 4,660,750 | A | | 4/1987 | Blanchard |
| 4,722,120 | A | * | 2/1988 | Lu ..... 24/489 |
| 4,729,498 | A | | 3/1988 | Blanchard |
| 4,739,912 | A | | 4/1988 | Klawieter et al. |
| 4,744,496 | A | | 5/1988 | Blanchard et al. |
| 4,746,039 | A | | 5/1988 | Batts et al. |
| D296,046 | S | | 6/1988 | Marshall |
| D296,729 | S | | 7/1988 | Blanchard |
| 4,759,480 | A | | 7/1988 | Duester et al. |
| D297,286 | S | | 8/1988 | Blanchard |
| 4,762,238 | A | | 8/1988 | Blanchard |
| D298,387 | S | | 11/1988 | Duester |
| D298,783 | S | | 12/1988 | Blanchard |
| D299,086 | S | | 12/1988 | Wilson |
| 4,793,531 | A | | 12/1988 | Blanchard et al. |
| D299,593 | S | | 1/1989 | Blanchard |
| 4,807,334 | A | | 2/1989 | Blanchard |
| 4,826,056 | A | | 5/1989 | Duester et al. |
| D301,661 | S | | 6/1989 | Wilson |
| D301,806 | S | | 6/1989 | Wilson |
| D301,808 | S | | 6/1989 | Marshall |
| D301,942 | S | | 7/1989 | Talbot-Titley |
| D301,943 | S | | 7/1989 | Wilson |
| D302,214 | S | | 7/1989 | Wilson |
| D303,324 | S | | 9/1989 | Wilson |
| D303,325 | S | | 9/1989 | Marshall |
| 4,871,097 | A | | 10/1989 | Blanchard et al. |
| 4,871,098 | A | | 10/1989 | Bredeweg et al. |
| 4,881,836 | A | | 11/1989 | Blanchard |
| 4,884,727 | A | | 12/1989 | Blanchard |
| 4,886,195 | A | | 12/1989 | Blanchard |
| 4,889,265 | A | | 12/1989 | Morgan |
| 4,892,237 | A | | 1/1990 | Duester et al. |
| D305,834 | S | | 2/1990 | DeVito |
| D305,835 | S | | 2/1990 | DeVito |
| 4,901,894 | A | | 2/1990 | Blanchard |
| D307,982 | S | | 5/1990 | Duester |
| 4,932,571 | A | | 6/1990 | Blanchard |
| 4,940,244 | A | | 7/1990 | Batts, III |
| 4,967,500 | A | | 11/1990 | Bredeweg |
| D316,334 | S | | 4/1991 | Duester |
| 5,020,705 | A | | 6/1991 | Garrison |
| 5,022,571 | A | | 6/1991 | Blanchard |
| 5,029,739 | A | | 7/1991 | Blanchard et al. |
| 5,052,600 | A | | 10/1991 | Elchisak et al. |
| 5,054,666 | A | | 10/1991 | Blanchard |
| 5,056,248 | A | | 10/1991 | Blanchard |
| 5,069,373 | A | | 12/1991 | Kolton et al. |
| 5,071,045 | A | | 12/1991 | Hollis |
| 5,074,447 | A | | 12/1991 | Kolton et al. |
| 5,082,153 | A | | 1/1992 | Duester et al. |
| D323,749 | S | | 2/1992 | Blanchard et al. |
| D324,313 | S | | 3/1992 | Kolton et al. |
| D324,459 | S | | 3/1992 | Gouldson et al. |
| 5,092,502 | A | | 3/1992 | Kolton et al. |
| 5,096,101 | A | | 3/1992 | Norman et al. |
| D325,822 | S | | 5/1992 | Hollis |
| D328,194 | S | | 7/1992 | Garrison |
| 5,129,557 | A | | 7/1992 | Kolton et al. |
| 5,135,141 | A | | 8/1992 | Harmer et al. |
| 5,137,191 | A | | 8/1992 | Blanchard et al. |
| D329,754 | S | | 9/1992 | Gouldson et al. |
| D329,755 | S | | 9/1992 | Gouldson |
| 5,155,881 | A | | 10/1992 | Lafferty |
| D331,869 | S | | 12/1992 | Batts et al. |
| 5,170,916 | A | | 12/1992 | Kolton et al. |
| D332,180 | S | | 1/1993 | Marshall et al. |
| D332,233 | S | | 1/1993 | Batts |
| 5,183,191 | A | * | 2/1993 | Garrison et al. ..... 223/96 |
| D334,096 | S | | 3/1993 | Blanchard |
| D334,846 | S | | 4/1993 | Blanchard |
| D335,581 | S | | 5/1993 | Gouldson |
| 5,212,854 | A | | 5/1993 | Hollis |
| D337,893 | S | | 8/1993 | Norman |
| D340,138 | S | | 10/1993 | Gouldson |
| D341,947 | S | | 12/1993 | Marshall et al. |
| 5,272,806 | A | | 12/1993 | Marshall et al. |
| 5,285,566 | A | | 2/1994 | Marshall et al. |
| 5,306,055 | A | | 4/1994 | Mainetti |
| D348,987 | S | | 7/1994 | Gouldson et al. |
| D350,236 | S | | 9/1994 | Gouldson et al. |
| 5,350,092 | A | | 9/1994 | Hollis |
| D352,834 | S | | 11/1994 | Norman |
| 5,361,948 | A | | 11/1994 | Batts |
| 5,388,354 | A | | 2/1995 | Marshall et al. |
| 5,398,854 | A | | 3/1995 | Blanchard |
| 5,400,932 | A | | 3/1995 | Hollis |
| 5,411,189 | A | | 5/1995 | Gouldson |
| D358,942 | S | | 6/1995 | Blanchard et al. |
| 5,441,182 | A | | 8/1995 | Sullivan |
| 5,449,099 | A | | 9/1995 | Blanchard |
| 5,469,995 | A | | 11/1995 | Bredeweg et al. |
| 5,477,995 | A | | 12/1995 | Dooley et al. |
| D368,376 | S | | 4/1996 | Gouldson et al. |
| 5,507,086 | A | | 4/1996 | Marshall et al. |
| 5,509,587 | A | | 4/1996 | Gouldson et al. |
| 5,516,013 | A | | 5/1996 | Gouldson et al. |
| 5,516,014 | A | | 5/1996 | Garrison |
| 5,524,801 | A | | 6/1996 | Dooley et al. |
| D371,246 | S | | 7/1996 | Gouldson et al. |
| 5,535,927 | A | | 7/1996 | Garrison |
| 5,558,280 | A | | 9/1996 | Morgan |
| 5,568,685 | A | | 10/1996 | Marshall et al. |
| D375,208 | S | | 11/1996 | Gouldson |
| D376,263 | S | | 12/1996 | Gouldson |
| 5,584,421 | A | | 12/1996 | Blanchard et al. |
| D377,717 | S | | 2/1997 | Gouldson |
| 5,604,975 | A | | 2/1997 | Marshall et al. |
| 5,613,630 | A | | 3/1997 | Isenga et al. |
| 5,628,132 | A | | 5/1997 | Marshall et al. |
| 5,683,018 | A | | 11/1997 | Sullivan et al. |
| D388,620 | S | | 1/1998 | Gouldson et al. |
| D388,964 | S | | 1/1998 | Gouldson |
| D390,015 | S | | 2/1998 | Gouldson |
| D392,113 | S | | 3/1998 | Gouldson |
| D394,754 | S | | 6/1998 | Gouldson |
| D396,353 | S | | 7/1998 | Gouldson |
| 5,775,553 | A | | 7/1998 | Marshall et al. |
| 5,775,575 | A | | 7/1998 | Dorman et al. |
| 5,785,216 | A | | 7/1998 | Gouldson et al. |
| 5,785,260 | A | | 7/1998 | Morgan |
| 5,794,363 | A | | 8/1998 | Marshall et al. |
| 5,803,321 | A | | 9/1998 | Willinger et al. |
| 5,814,252 | A | | 9/1998 | Gouldson et al. |
| D400,718 | S | | 11/1998 | Bortolus |
| 5,857,276 | A | | 1/1999 | Marshall et al. |
| D405,964 | S | | 2/1999 | Willinger |

5,884,422 A 3/1999 Marshall et al.
5,890,634 A * 4/1999 Zuckerman et al. ..... 223/96
5,894,923 A 4/1999 Hamstra et al.
D409,006 S 5/1999 Blanchard
D409,400 S 5/1999 Peruzzo
D409,846 S 5/1999 Blanchard
D410,793 S 6/1999 Gouldson
5,915,605 A 6/1999 Blanchard
5,934,525 A 8/1999 Blanchard
5,944,237 A 8/1999 Gouldson
D413,446 S 9/1999 Gouldson
D414,044 S 9/1999 Choi et al.
5,950,885 A 9/1999 Morgan
D414,946 S 10/1999 Gouldson
D415,357 S 10/1999 Blanchard
5,992,714 A 11/1999 Morgan
5,996,862 A 12/1999 Peruzzo et al.
D418,311 S 1/2000 Gouldson
6,019,260 A 2/2000 Gouldson
6,019,261 A 2/2000 Morgan et al.
6,023,819 A 2/2000 Wong et al.
6,029,868 A 2/2000 Willinger et al.
6,041,983 A 3/2000 Sullivan et al.
6,041,984 A 3/2000 Gouldson
D423,234 S 4/2000 Gouldson
6,050,461 A 4/2000 Batts et al.
6,055,350 A 4/2000 Brown et al.
D423,797 S 5/2000 Gouldson
D424,817 S 5/2000 Morgan et al.
6,076,863 A 6/2000 Platt Brown et al.
6,085,950 A 7/2000 Gouldson et al.
D429,898 S 8/2000 Morgan et al.
6,098,254 A 8/2000 Willinger
6,105,834 A 8/2000 Cohen
6,105,836 A 8/2000 Batts et al.
RE36,873 E 9/2000 Gouldson et al.
6,128,932 A 10/2000 Mainetti et al.
D435,173 S 12/2000 Morgan et al.
6,158,635 A 12/2000 Batts
D435,973 S 1/2001 Gouldson
D436,743 S 1/2001 Batts et al.
6,173,872 B1 * 1/2001 Cohen ..... 223/96
6,189,746 B1 2/2001 Gouldson
6,196,430 B1 3/2001 Gouldson
6,199,728 B1 * 3/2001 Cohen ..... 223/96
D439,751 S 4/2001 Gouldson
D440,409 S 4/2001 Blanchard
D440,410 S 4/2001 Gouldson
D441,550 S 5/2001 Gouldson
6,241,133 B1 6/2001 Morgan et al.
6,260,745 B1 7/2001 Gouldson et al.
6,264,075 B1 7/2001 Gouldson et al.
D447,878 S 9/2001 Hawkins
6,289,569 B1 9/2001 Marshall et al.
D449,743 S 10/2001 Morgan
6,305,586 B1 10/2001 Wong
6,306,329 B1 * 10/2001 Willinger ..... 223/91
6,308,872 B1 10/2001 Duerr et al.
D450,463 S 11/2001 Wong et al.
D450,464 S 11/2001 Olk et al.
D451,291 S 12/2001 Hawkins
D453,423 S 2/2002 Goldman et al.
D454,006 S 3/2002 Gouldson
D454,435 S 3/2002 Willinger
6,357,638 B2 3/2002 Gouldson
6,378,744 B2 4/2002 Olk et al.
6,382,478 B2 5/2002 Gouldson et al.
D458,039 S 6/2002 Gouldson
D459,593 S 7/2002 Gouldson
6,421,910 B1 7/2002 Marshall et al.
6,422,437 B2 7/2002 Gouldson et al.
6,422,438 B1 7/2002 Batts
6,435,387 B1 8/2002 Gouldson et al.
D463,918 S 10/2002 Goldman et al.
6,467,658 B1 10/2002 Olk et al.
6,467,659 B2 10/2002 Gouldson
6,474,517 B1 11/2002 Sutton
6,484,390 B1 11/2002 Gouldson et al.
D466,311 S 12/2002 Hawkins
D466,704 S 12/2002 Hawkins
D466,705 S 12/2002 Hawkins
6,499,633 B1 12/2002 Pogmore
6,499,634 B2 12/2002 Olk et al.
D469,964 S 2/2003 Gouldson
6,516,980 B1 2/2003 Goldman
6,523,240 B1 2/2003 Gouldson
D472,394 S 4/2003 Hawkins
6,564,980 B2 5/2003 Gouldson et al.
6,588,634 B2 7/2003 Gouldson et al.
6,609,640 B1 8/2003 Bokmiller
6,609,641 B2 8/2003 Sutton
6,612,000 B2 9/2003 Housley
6,675,997 B1 1/2004 Gouldson et al.
6,681,966 B2 1/2004 Gouldson et al.
6,705,496 B2 3/2004 Marshall et al.
6,711,808 B2 3/2004 Sollanek et al.
6,715,650 B2 4/2004 Gouldson
6,742,228 B1 * 6/2004 Kim ..... 24/507
6,743,323 B2 6/2004 Mainetti
6,758,379 B1 7/2004 Elwell
6,772,923 B2 8/2004 Olk et al.
D498,935 S 11/2004 Gouldson
D498,936 S 11/2004 Gouldson
D500,412 S 1/2005 Gouldson
D501,092 S 1/2005 Mainetti
D502,009 S 2/2005 Gouldson
D502,011 S 2/2005 Gouldson
D502,328 S 3/2005 Gouldson
D502,606 S 3/2005 Gouldson
D502,651 S 3/2005 Gouldson
D503,287 S 3/2005 Gouldson
6,865,832 B1 3/2005 Goldman
6,871,765 B2 3/2005 Mainetti
D504,024 S 4/2005 Mainetti
6,874,666 B2 4/2005 Gouldson et al.
6,875,392 B2 4/2005 Olk et al.
6,892,910 B2 5/2005 Capuano et al.
D506,077 S 6/2005 Pluchino et al.
D506,320 S 6/2005 Gouldson
D506,619 S 6/2005 Mainetti
D507,418 S 7/2005 Mainetti
D507,419 S 7/2005 Gouldson
6,915,931 B2 7/2005 Gouldson et al.
6,923,350 B2 8/2005 Gouldson et al.
6,926,180 B2 8/2005 Mainetti
D511,049 S 11/2005 Gouldson
D512,571 S 12/2005 Gouldson et al.
D515,320 S 2/2006 Sutton et al.
D515,321 S 2/2006 Sutton et al.
D515,322 S 2/2006 Sutton et al.
D515,829 S 2/2006 Sutton et al.
D517,818 S 3/2006 Sutton et al.
7,150,381 B2 * 12/2006 Goldman ..... 223/91
7,188,755 B2 * 3/2007 Wu ..... 223/91
7,249,698 B2 * 7/2007 Sutton et al. ..... 223/91
2001/0011663 A1 8/2001 Olk et al.
2001/0016994 A1 8/2001 Gouldson et al.
2001/0019070 A1 9/2001 Gouldson et al.
2002/0056734 A1 5/2002 Olk et al.
2002/0070251 A1 6/2002 Gouldson et al.
2002/0190090 A1 12/2002 Gouldson et al.
2003/0126725 A1 7/2003 Housley
2003/0136804 A1 7/2003 Gouldson et al.
2003/0154594 A1 8/2003 Sollanek et al.
2003/0183665 A1 10/2003 Olk et al.
2003/0209577 A1 11/2003 Gouldson et al.

2004/0004096 A1 1/2004 Gouldson et al.
2004/0065702 A1* 4/2004 Yang ..... 223/96
2004/0163239 A1 8/2004 Sollanek et al.
2004/0182891 A1 9/2004 Mainetti
2004/0188475 A1 9/2004 Gouldson
2004/0200865 A1 10/2004 Mainetti
2004/0206788 A1 10/2004 Capuano et al.
2004/0222252 A1 11/2004 Gouldson et al.
2004/0222254 A1 11/2004 Olk et al.
2005/0067445 A1 3/2005 De Groot
2005/0139625 A1 6/2005 Gouldson
2005/0184109 A1* 8/2005 Goldman ..... 223/95
2005/0194412 A1 9/2005 Petrou
2006/0163294 A1* 7/2006 Sutton et al. ..... 223/85
2006/0186148 A1* 8/2006 Wu ..... 223/85
2006/0226178 A1* 10/2006 Wu ..... 223/85

* cited by examiner 102
104
106
110
108

150
154
158
156
152

9A

PINCH CLIP GARMENT HANGER WITH MODULAR FRICTION PADS

CROSS-REFERENCE TO RELATED APPLICATIONS

This application claims priority to U.S. Provisional Application No. 60/744,695, filed Apr. 12, 2006, entitled "Pinch Clip Garment Hanger with Modular Friction Pads," the contents of which are incorporated herein by reference in its entirety.

TECHNICAL FIELD

This disclosure relates to a garment hanger, and more particularly to pinch clip garment hangers with friction pads.

BACKGROUND

Numerous types of hangers have been used to hang garments, such as skirts, slacks and pants. Generally, many of these hangers use clips to hold the garment on the hanger. For example, some conventional hanger assemblies utilize an elongated crossbar having clip members integrally formed with the crossbar. These clip members include cooperating jaw members and an intermediate hinge member that connects the clip members, as well as a spring that biases the jaw members against each other.

A common failing of conventional pinch clip designs is the inability to adequately grip a garment. This problem has been addressed by including friction pads on opposing gripping jaws that are biased together to increase the friction coefficient between the gripping portion of the jaw and the clothing article to prevent slippage. While it is desirable to have an effective gripping portion such as rubber or a rubber-like material, manufacture involving such materials is laborious and costly because the friction pad is either affixed to the jaw with adhesive, or molded onto the surface of the pinch clip jaw.

Additionally, garments often fall from the hanger when pinch clips touch hangers or objects adjacent to the hanger, thereby causing the garment to be released from the clip.

This disclosure addresses these issues, as well as others.

SUMMARY

Generally, in some embodiments, a pinch clip member has first and second moveable jaw members that are pivotally secured to each other, wherein one of the moveable jaw members attaches to the cross member without being integrally molded thereto.

In one embodiment, a pinch clip garment hanger includes a cross member, a hook member, and at least one pinch clip member. The pinch clip member may have a fixed jaw member integrally molded to the cross member, a moveable jaw member pivotally secured to the fixed jaw member, and a biasing spring that holds the jaw members together. The fixed jaw member has a first surface facing the moveable jaw member, and the moveable jaw member has a second surface facing the fixed jaw member. The first and second surfaces are pressed together by the biasing spring to hold the garment that is positioned between the fixed and moveable jaw members. At least one surface of the first and second surfaces has a friction pad. The friction pad surface can be flat or another shape that complements the shape of the opposing surface.

In another embodiment, at least one surface of the first and second surfaces has a friction-enhancing pad and the opposing surface has a set of teeth for gripping a garment.

In some embodiments, the friction pad may be attached to a jaw member using a securing ring that secures the friction pad in place over a receiving portion that houses the friction pad. The securing ring may be secured to the jaw member with a latch. Alternatively, in some embodiments, the friction pad may be secured in a jaw member with a securing member that is substantially enclosed in the jaw member and allows the friction pad to be placed and secured in the jaw member via the side of the clip that is opposite to the friction pad.

In another aspect of the disclosure, when lying horizontally, the garment hanger is disposed in such a manner that the pivot post section of the garment hanger possesses the largest height relative to other portions of the clip. An advantage of such design is that, when two hangers are held next to each other, the upper ends of the clips will not push against each other so as to cause the jaws to open, inadvertently releasing the garment.

BRIEF DESCRIPTION OF THE DRAWINGS

For a more complete understanding of the principles disclosed herein, and the advantages thereof, reference is now made to the following descriptions taken in conjunction with the accompanying drawings, in which.

DETAILED DESCRIPTION

Figures 1, 2, 3A, 3B:
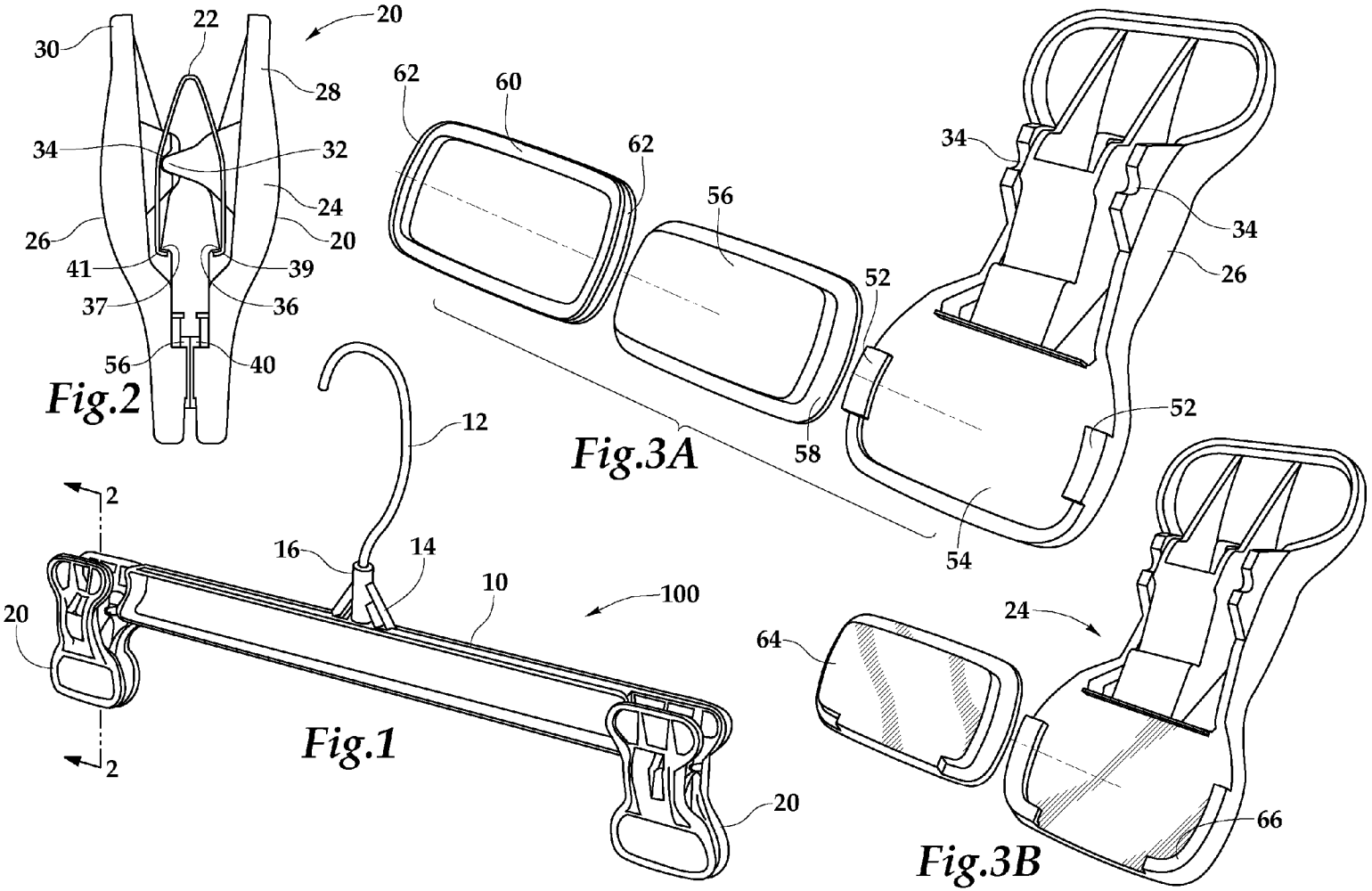
FIG. 1 is a perspective view of an exemplary hanger in accordance with the present disclosure.
FIG. 2 is a side view of an exemplary pinch clip of the hanger of FIG. 1.
FIG. 3A is an exploded perspective view of a first embodiment of an exemplary jaw member illustrating components in a disassembled state, in accordance with the present disclosure.
FIG. 3B is an exploded perspective view of another embodiment of an exemplary jaw member illustrating components in a disassembled state, in accordance with the present disclosure.

Referring now to FIG. 1, illustrated is a perspective view of a hanger according to the present disclosure, generally designated by reference numeral 100. Garment hanger 100 is capable of holding pants, skirts, shorts, and other garments. Garment hanger 100 includes a cross member 10, and a hook member 12 of conventional configuration for hanging on a rail. Hook member 12 is coupled to cross member 10 by collar for receiving hook 14 and is supported by collar 16. The hook member 12 may be formed of metal, but in other configurations may be plastic, as part of the cross member 10 molding. Cross member 10 may be of I-beam construction or any such similar structure providing rigidity. Cross member 10 may be made using vacuum molding, injection molding techniques, or the like, and may be made of translucent or colored plastic material. As shown, pinch clips 20 are disposed at opposing terminal ends of cross member 10. Alternatively or in addition, pinch clips 20 may be positioned on sliders and positioned along cross member 10. Further alternatively or in addition, pinch clips 20 may incorporate the teachings of U.S. Provisional Pat. App. No. 60/596,608 entitled "Pinch Clip Garment Hanger," filed on Oct. 5, 2005, which is hereby incorporated by reference for all purposes.

FIG. 2 illustrates a side view of an embodiment of an exemplary pinch clip 20. Each pinch clip 20 includes a fixed jaw member 24 integrally molded to the cross member 10, and a moveable jaw member 26 pivotally secured to the fixed jaw member with biasing spring member 22. Fixed jaw member 24 includes a first friction pad 40, a first arm 28, a pivot post 32, and retaining nodule 36. Moveable jaw member 26 includes a second friction pad 56, a socket 34, a second arm 30, and a retaining nodule 37.

Friction pads 40, 56 provide desired friction for maintaining grip of a garment. As used herein, "friction pads" may be made from materials having improved gripping properties, including but not limited to rubber, rubberized plastics, polymers, and other materials having similar properties. Friction pads may be molded into various shapes. In this exemplary embodiment, the profile of friction pads 40, 56 may be flat. In other embodiments, a friction pad may have other profile shapes, including teeth, bumps, and various other designs. In some embodiments, profile shapes on two opposing jaws may be complementary to each other such that a depression in a pad on one side fits into a raised portion on the opposite side when the jaws are biased together. In other embodiments, a profile shape may be located on one jaw, and a flat surface may be located on the opposing jaw.

Moveable jaw member 26 is pivotally secured to the fixed jaw member using biasing spring member 22. Biasing spring member 22 keeps the jaw together, ensuring coupling of the moveable jaw member and the fixed jaw member 24. The biasing spring has a first leg end 39 and a second leg end 41, configured to secure the biasing spring member to the respective jaw member. Retaining nodules 36 and 37 prevent biasing spring member 22 from releasing. However, the biasing spring member 22 is releasable with a suitable tool, such as a pry bar or a screwdriver. Retaining nodules 36 or 37 may also be other means that prevent the biasing spring 22 from releasing, such as indentations, notches, slots, cavities and the like. As shown in FIG. 2, pivot post 32 is integrally molded with the fixed jaw member 24. Socket 34 is integrally molded with moveable jaw member 26. Pivot post 32 fits into socket 34 such that a fulcrum is provided for pivotally securing the movable jaw member 26 to the fixed jaw member 24. The first arm 28 is integrally molded with cross member 10 and fixed jaw member 24. The second arm 30 is integrally molded with moveable jaw member 26.

In operation, the user of the hanger 100 compressibly squeezes the second arm 30 toward the first arm 28, such that when released, the biasing spring member 22 returns the first friction pad 40 proximate to the second friction pad 56. Although a fixed jaw member 24 and a moveable jaw member 26 are shown in this exemplary embodiment, in other embodiments there may be other combinations of jaw members, for example, two moveable jaw members that are in opposition to each other.

FIG. 3A illustrates an exploded perspective view of a first embodiment of a jaw member, illustrating components in a disassembled state. This first embodiment includes a jaw member 26, a friction pad 56, and a securing ring 60 for securing friction pad 56 to jaw member 26. Friction pad 56 may have flat surfaces on the face and back of the pad, with recessed edges 58 at the periphery. This profile allows securing ring 60 to fit over friction pad 56 such that the face of friction pad 56 extends beyond the securing ring 60. Securing ring 60 may be made from a hard material, such as a polymer or plastic, that may be similar to the material used for the jaw member 26. The combined securing ring 60 and friction pad 56 may then be attached to the jaw member 26 by latching the thin edges 62 of securing ring 60 into latches 52 on either side of jaw member 26. Accordingly, a pinch clip jaw member is now assembled with a modular friction pad that is substantially flush with the edges of the gripping end, and can be disassembled as necessary. It should be appreciated that latches 52 may be placed elsewhere on jaw member 26, and that other latching schemes may be used as an equivalent to the exemplary scheme. For instance, latches 52 may also be provided by a receiving cavity that is formed in molding jaw member 26. Similarly, although not shown, a securing ring may be used to secure friction pad 40 to jaw member 24, which opposes jaw member 26. It is to be further appreciated that the jaw member 24 may not include a securing ring. Rather, with reference to FIG. 3B, the modularity of the jaw member 24 may be achieved via a pad 64, which may slide into, or otherwise attach to (e.g., snap-fit), a guide portion 66 of the jaw member 24. To facilitate such an arrangement, the pad 64 may be shaped, or otherwise contoured, in a manner corresponding to the positioning of the guide portion 66. Of course, the pad 64 and guide portion 66 may take on a variety of suitable corresponding configurations.

Figure 4:
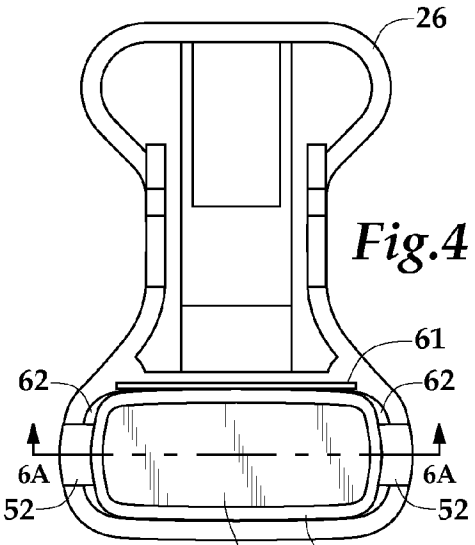
FIG. 4 is a forward view of the jaw member of FIG. 3A in an assembled state in accordance with the present disclosure.

FIG. 4 is forward view of the first embodiment exemplary jaw member in an assembled state. In combination, the securing ring 60 and friction pad 56 are secured by the latches 52. A cavity may be formed in jaw member 26 to receive the combined securing ring 60 and friction pad 56. Further, guiding ridges 61 that extend from the surface of jaw member 26 may provide lateral support to the combination of friction pad 56 and securing ring 60.

Figure 5:
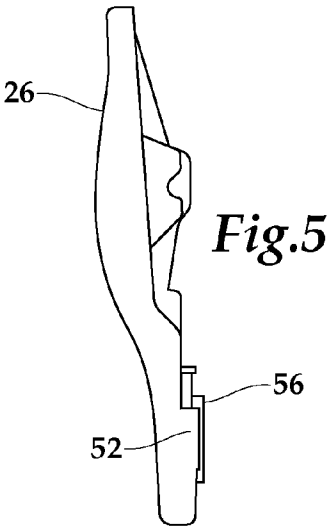
FIG. 5 is a side view of the jaw member of FIG. 4 in an assembled state.

FIG. 5 is a side view of the jaw member of FIG. 4 in an assembled state. The friction pad 56 extends beyond the latches 52 such that when jaw members 24, 26 are biased together, the friction pads on each jaw member 24, 26 make contact with each other without obstructions.

Figure 6A:
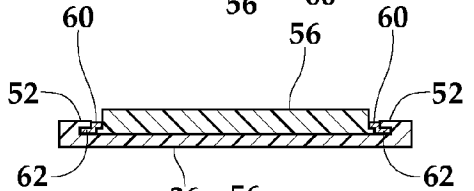
FIGS. 6A and 6B are sectional views of the jaw member of FIG. 4 along line 6A of FIG. 4, in assembled and disassembled states respectively.

FIG. 6A is a sectional view of the jaw member of FIG. 4 along line 6A of FIG. 4 in an assembled state. This sectional view illustrates the friction pad 56 being secured by the securing ring 60, which is in turn secured to jaw member 24 via latches 52 and the thin edges 62 of securing ring 60.

Figure 6B:
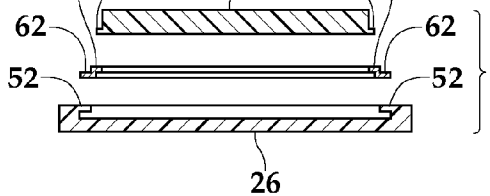

FIG. 6B is a sectional view of the jaw member of FIG. 4 in a disassembled state. It should be noted that once assembled, the securing ring 60 mechanically secures the friction pad 56 to jaw member 26. However, for further security the securing ring 60 may be permanently affixed to jaw member 26 using glue, chemical bonding, plastic welding, and like techniques.

Figure 7:
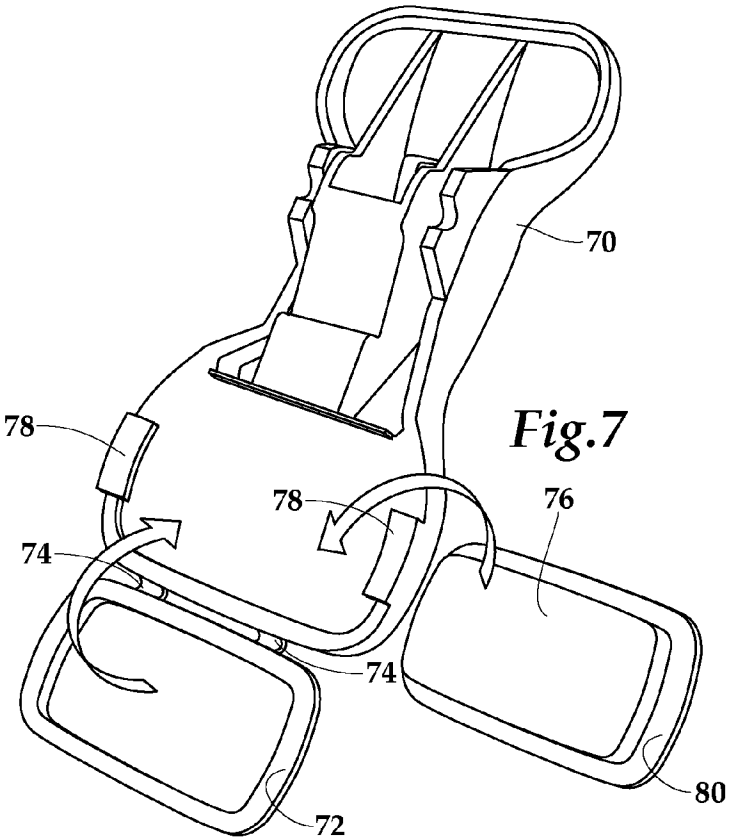
FIG. 7 is a an exploded perspective view of another exemplary embodiment of a jaw member in accordance with the present disclosure.

FIG. 7 is an exploded perspective view of another exemplary embodiment of a jaw member in accordance with the present disclosure. Jaw member 70 is similar in function to the aforementioned embodiment, however, securing ring 72 is integrally molded to the body of jaw member 70 via hinges 74. Hinges 74 may be plastic, and they are sufficiently thin and pliable to allow bending without fracturing. Thus, a simplified assembly process may result through the use of fewer components to handle. Accordingly, the friction pad 76 may be placed into the securing ring 72, and then folded over and secured via the latches 78 and the thin edges (not shown in this view) on securing ring 72. It should be appreciated that there may be one or several hinges 74 and latches 78, and that the hinges and latches may be placed in other positions for the purpose of securing the friction pad 76.

Figures 8, 9A, 9B, 10, 11A, 11B, 12, 13:
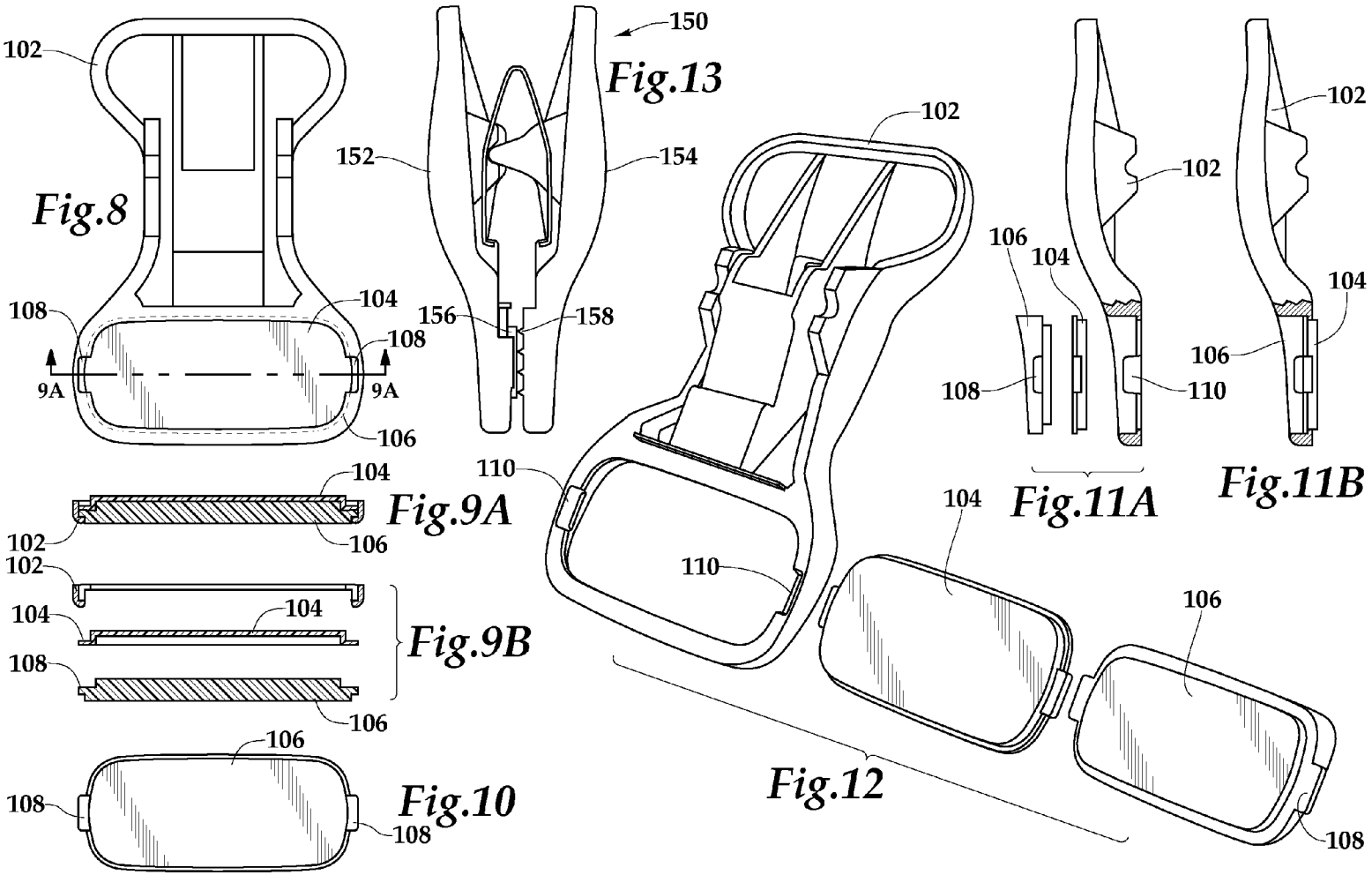
FIG. 8 is a forward view of another exemplary embodiment of a jaw member in an assembled state in accordance with the present disclosure.
FIGS. 9A and 9B are sectional views of the jaw member of FIG. 8 along line 9A of FIG. 8, in assembled and disassembled states respectively.
FIG. 10 is a forward view of a securing member in accordance with the present disclosure.
FIGS. 11A and 11B are sectional side views of the jaw member of FIG. 8 in a disassembled state and an assembled state respectively.
FIG. 12 is an exploded perspective view of an exemplary jaw member illustrating components in a disassembled state, in accordance with the present disclosure.
FIG. 13 is a side view of an another embodiment of an exemplary pinch clip, in accordance with the present disclosure.

FIG. 8 is a forward view of another exemplary embodiment of a jaw member in an assembled state. In this embodiment, a friction pad 104 may be secured with a jaw member 102 via a securing member 106. Clips 108 are integrally molded into securing member 106. In contrast to the previously described embodiments, this embodiment allows the friction pad 104 to be inserted in the jaw member 102 from the non-contact side (i.e., the rear side), wherein the securing member 106 secures the friction pad 104 in place via the clips 108.

FIGS. 9A and 9B are sectional views of the jaw member of FIG. 8 along line 9A of FIG. 8, in assembled and disassembled states respectively. This sectional view illustrates the friction pad 104 being secured to jaw member 102 by the securing member 106 via clips 108 and latches 110. In construction, the friction pad 104 may be inserted into jaw member 102, then securing member 106 may be secured into the jaw member 102, as described.

FIG. 10 is a forward view of a securing member 106. The securing member 106 may be manufactured from a similar material to jaw member 102, although it should be sufficiently flexible to allow the securing of clips 108 into latches 110. In appearance, the securing member 106 could be of various colors, which may be placed on jaw member 102 in order to indicate information. For instance, color and/or textual information on securing member 106 may represent, for example, garment sizes, prices, a store name, a hotel name, sale items, garment range styles, or any other retail information that is associated with the garment to be hung, or an establishment. This is not an exclusive listing of information, and it should be appreciated by a person of ordinary skill in the art, that other types of information may be displayed on securing member 106.

FIGS. 11A and 11B are sectional side views of the jaw member of FIG. 8 in a disassembled state and an assembled state, respectively. These sectional side views illustrate the friction pad 104 being secured to jaw member 102 by the securing member 106 via clips 108 and latches 110. In construction, the friction pad 104 may be inserted into jaw member 102, then securing member 106 may be secured into the jaw member 102. When constructed, securing member 106 may provide a flush fit with the outer surface of jaw member 102.

FIG. 12 is an exploded perspective view of another embodiment of an exemplary jaw member illustrating components in a disassembled state. As described above, the friction pad 104 is placed in the jaw member 102 from the rear side, aligned via latches 110. The recessed edges of friction pad 104 allow for a secure fit, particularly once secured with securing member 106 via the combination of clips 108 and latches 110. In some embodiments, the securing member 106 might be released from the jaw member 102 using an appropriate levering device (e.g., a small flathead screwdriver) to leverage clip 108 from latch 110.

FIG. 13 illustrates a side view of another embodiment of an exemplary pinch clip 150. This embodiment is similar to the embodiment shown with reference to FIG. 2, except that the first jaw member 152 includes a rubberized friction pad 156, while the second jaw member 154 includes a set of teeth 158. The combination of a rubberized friction pad 156 with teeth 158 on opposing jaw members 152, 154 may provide desired grip on a garment.

Figure 14:
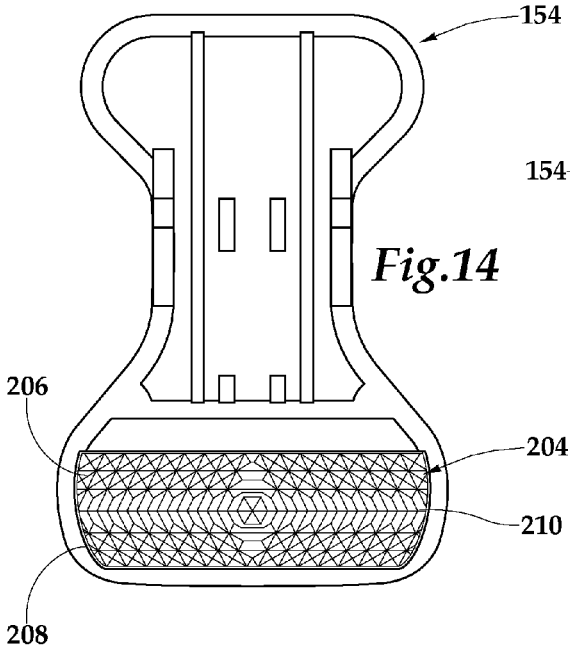
FIG. 14 is a forward view of another exemplary embodiment of a jaw member in accordance with the present disclosure.

FIG. 14 is a forward view of another embodiment of a jaw member. It should be apparent to a person of ordinary skill in the art that various alternative designs for teeth or gripping means may be employed for the jaw member 154, including but not limited to those described in commonly-assigned U.S. patent application Ser. No. 11/537,987, entitled "Pinch clip garment hanger," filed Oct. 2, 2006, and commonly-assigned U.S. Design patent application. Ser. No. 29/254,137, entitled "Pinch Clip Grip", both of which are herein incorporated by reference in their entireties. Particular reference is made to FIG. 14, wherein teeth 204 are in multiple shapes. In this example, some of the teeth 204 have sharp tips so as to provide a satisfactory grip on the garment. In various embodiments, the height of the teeth 204 can vary according to the type of material of the garment to be hung between the jaw members. For instance, if the material is delicate, teeth 204 with relatively low height may be used—for example, the height of the teeth 204 can be in the range between approximately 0.5 mm and 1.0 mm. Generally speaking, for the ease of molding during manufacturing, the height of the teeth 204 is preferably more than 0.5 mm. For garment materials that are not so delicate, teeth 204 with much greater heights can be used. In addition, the pattern of the teeth 204 can vary from one embodiment to another as well. As shown in FIG. 14, the first two rows 206 and the last two rows 208 of the teeth 204 can be in the diamond shape with tips that are substantially sharp. The middle rows 210 of teeth 204 can take the form of elongated ridges so that, although the edges of the ridges are of acute angles, the ridges when viewed as a whole do not form sharp tips.

Figure 15:
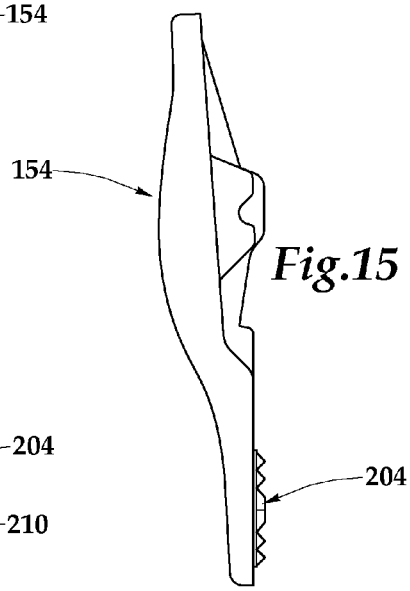
FIG. 15 is a side view of the jaw member of FIG. 14.
Figure 16:
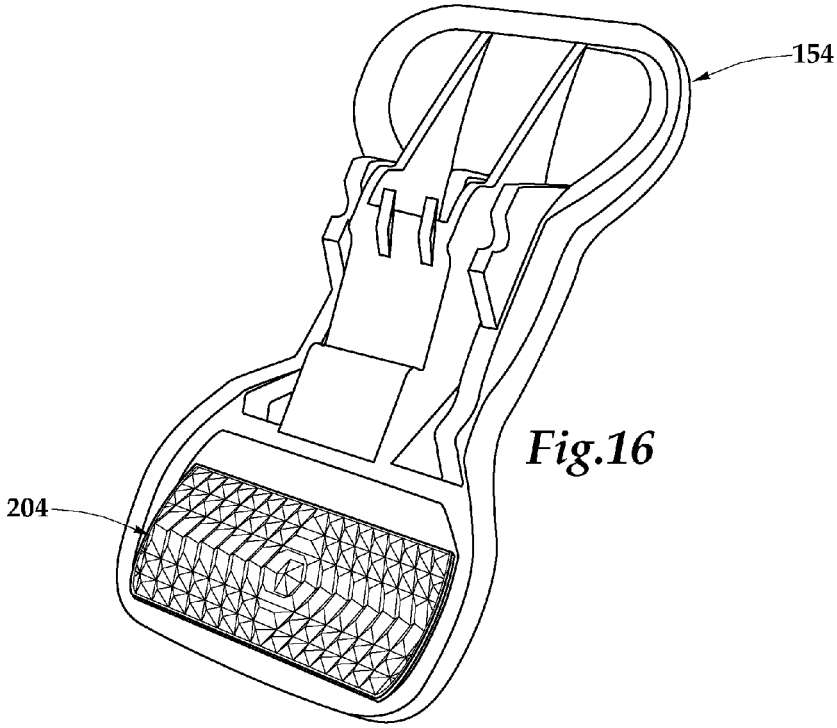
FIG. 16 is a perspective view of the jaw member of FIG. 14.

FIG. 15 is a side view of the jaw member of FIG. 14. It should be appararent to a person of ordinary skill in the art that such a grip may be located on the opposite grip member to that shown in the figure. FIG. 16 further illustrates the jaw member of FIG. 14 in a perspective view.

Figure 17A:
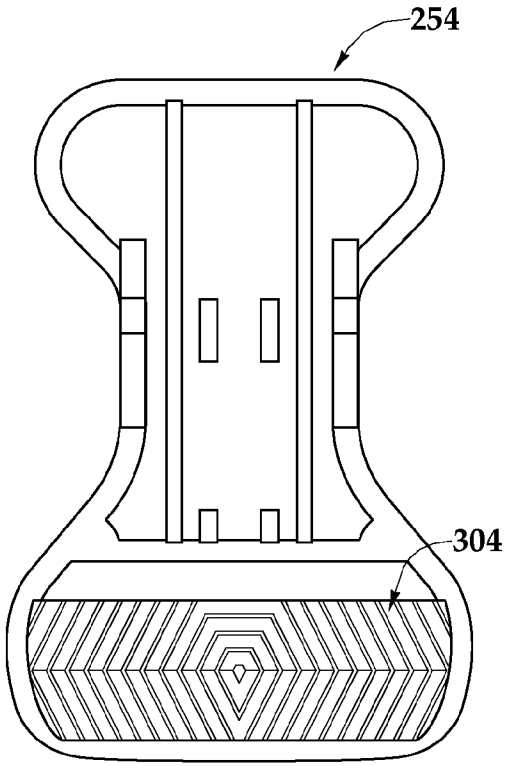
FIG. 17A is a forward view of another exemplary embodiment of a jaw member in accordance with the present disclosure.
Figure 17B:
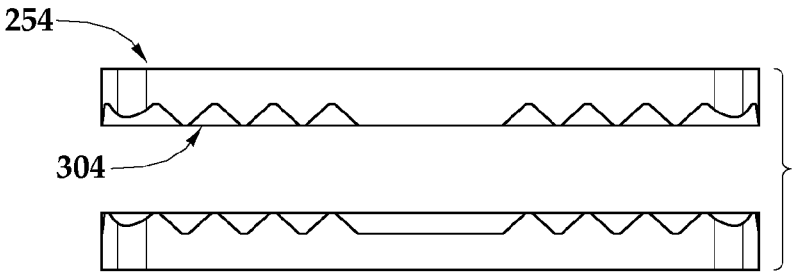
FIGS. 17B and 17C are partial end views of the jaw member of FIG. 17A in open and closed arrangements, respectively.
Figure 17C:
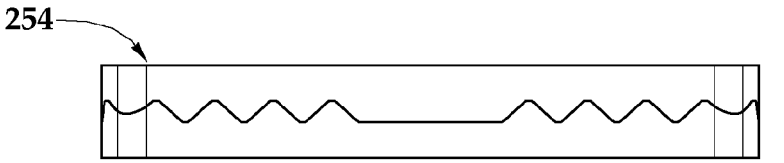

FIG. 17A illustrates another embodiment of a jaw member 254 according to the present disclosure. The jaw member 254 includes teeth 304, which extend longitudinally in a first direction away from an upper portion of the gripping area (as illustrated in FIG. 17A) and in a second direction from a mid-portion of the gripping area. FIGS. 17B and 17C further illustrate opposing portions of the jaw member 254 in an open arrangement (FIG. 17B) and a closed arrangement (FIG. 17C).

Figure 18A:
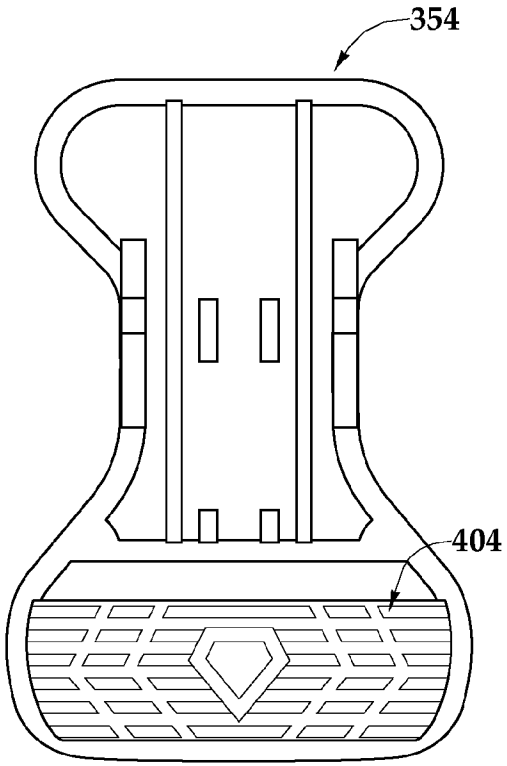
FIG. 18A is a forward view of another exemplary embodiment of a jaw member in accordance with the present disclosure.
Figure 18B:
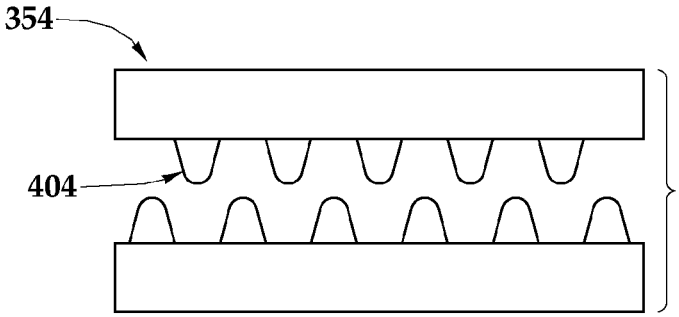
FIGS. 18B and 18C are partial end views of the jaw member of FIG. 18A in open and closed arrangements, respectively.
Figure 18C:
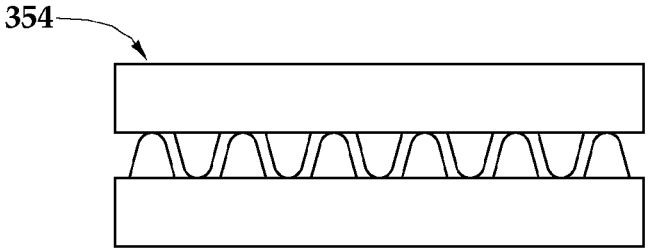

FIG. 18A illustrates another embodiment of a jaw member 354 according to the present disclosure. The jaw member 354 includes teeth 404, which are generally rounded in configuration as illustrated in the end views of FIG. 18B (open arrangement) and FIG. 18C (closed arrangement).

Figure 19A:
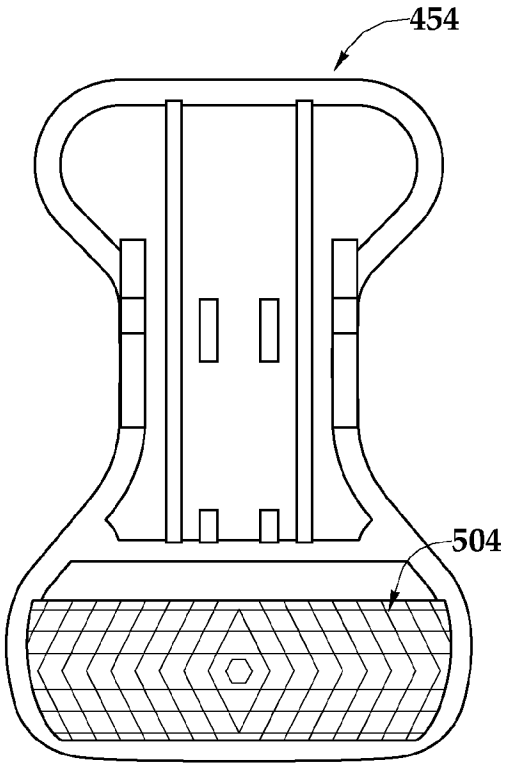
FIG. 19A is a forward view of another exemplary embodiment of a jaw member in accordance with the present disclosure.
Figure 19B:
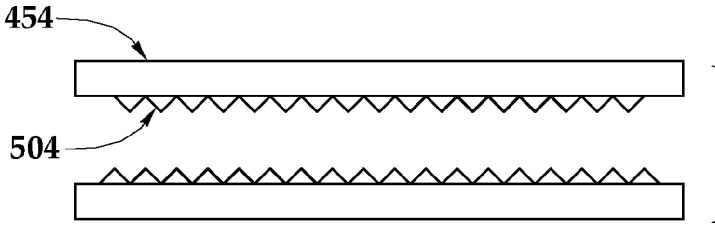
FIGS. 19B and 19C are partial end view of the jaw member of FIG. 19A in open and closed arrangements, respectively.
Figure 19C:
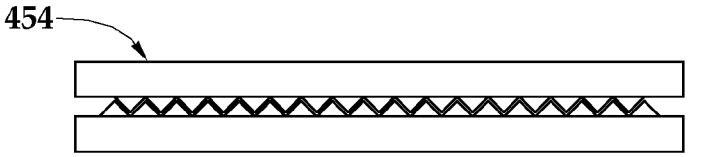

FIG. 19A illustrates yet another embodiment of a jaw member 454 according to the present disclosure. The jaw member 454 includes teeth 504, which are formed to have substantially sharp tips. FIGS. 19B and 19C further illustrate opposing portions of the jaw member 454 in an open arrangement (FIG. 19B) and a closed arrangement (FIG. 19C).

While various embodiments of a garment hanger according to the principles disclosed herein have been described above, it should be understood that they have been presented by way of example only, and not limitation. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A pinch clip garment hanger comprising:

a first jaw member;

a second jaw member, pivotally secured to the first jaw member;

wherein the first jaw member comprises:

a modular friction pad;

a receiving portion that houses the modular friction pad, the receiving portion comprising at least one latch; and a securing device releasably coupled to the modular friction pad, wherein the securing device comprises a securing ring, the securing ring being operable to engage the at least one latch and secure the modular friction pad to the receiving portion.

2. A pinch clip garment hanger according to claim 1, wherein the friction pad is rubberized and comprises a contact surface and a non-contact surface, the contact surface disposed for contacting with a garment, the non-contact surface being the opposing side to the contact surface.

3. A pinch clip garment hanger according to claim 2, wherein the rubberized friction pad comprises ledges extending from the non-contact surface.

4. A pinch clip garment hanger according to claim 3, wherein the ledges are operable to retain the rubberized friction pad between the securing device and the receiving portion.

5. A pinch clip garment hanger according to claim 4 wherein the contact surface of the rubberized friction pad protrudes beyond the securing device.

6. A pinch clip garment hanger according to claim 1, wherein the second jaw member comprises:

a rubberized friction pad;

a second receiving portion that houses the rubberized friction pad; and a securing device operable to secure the rubberized friction pad to the second receiving portion.

7. A pinch clip garment hanger according to claim 1, wherein the second jaw member comprises a set of teeth.

8. A pinch clip garment hanger according to claim 7, wherein each tooth has a triangular profile.

9. A pinch clip garment hanger according to claim 8, wherein each tooth is separated from the adjacent tooth by a toothless portion.

10. A pinch clip garment hanger according to claim 9, wherein the leading edges of the first set of teeth are collectively in tapered relation from top to bottom.

11. A pinch clip garment hanger according to claim 1, wherein the receiving portion includes a guide portion for retaining the modular friction pad on the receiving portion.

12. A pinch clip garment hanger according to 11, wherein the second jaw member comprises a set of teeth.

13. A pinch clip garment hanger according to claim 1, wherein the second jaw member comprises:

a second modular friction pad;

a second receiving portion that houses the second modular friction pad, the second receiving portion including a guide portion for retaining the second modular friction pad on the second receiving portion.

14. A method for assembling a modular jaw member of a pinch clip garment hanger, the method comprising the steps of:

providing a first jaw member having a receiving portion, the receiving portion comprising at least one latch;

providing a second jaw member;

pivotally securing the first jaw member to the second jaw member;

mounting a securing device to a modular friction pad, the securing device comprising a securing ring;

seating the modular friction pad in the receiving portion; and engaging the securing ring with the at least one latch to removably secure the modular friction pad to the receiving portion.

15. A method according to claim 14, further comprising engaging the modular friction pad with a guide portion integral to the receiving portion.

* * * * *